US007323668B2

(12) United States Patent
Benitsch

(10) Patent No.: US 7,323,668 B2
(45) Date of Patent: Jan. 29, 2008

(54) WORKPIECE CARRIER FOR THE INDUCTIVE HEATING OF WORKPIECES, PROCESS FOR PRODUCING A CERAMIC MATERIAL FOR THE WORKPIECE CARRIER AND PROCESS FOR THE INDUCTIVE HEATING OR HARDENING OF WORKPIECES

(75) Inventor: Bodo Benitsch, Buttenwiesen (DE)

(73) Assignee: SGL Carbon AG, Wiesbaden (DE)

( * ) Notice: Subject to any disclaimer, the term of this patent is extended or adjusted under 35 U.S.C. 154(b) by 4 days.

(21) Appl. No.: 11/080,712

(22) Filed: Mar. 15, 2005

(65) Prior Publication Data

US 2005/0242089 A1 Nov. 3, 2005

(30) Foreign Application Priority Data

Apr. 30, 2004 (EP) ..... 04010372

(51) Int. Cl.
*H05B 6/22* (2006.01)

(52) U.S. Cl. ..... 219/649; 219/647

(58) Field of Classification Search ..... 219/649, 219/647, 648, 622; *H05B 6/12, 6/22*
See application file for complete search history.

(56) References Cited

U.S. PATENT DOCUMENTS

| | | | | |
|---|---|---|---|---|
| 2,482,364 | A | | 9/1949 | Pfleger |
| 3,182,168 | A | | 5/1965 | Cornell |
| 3,383,840 | A | * | 5/1968 | Johnson et al. ..... 55/293 |
| 4,469,925 | A | * | 9/1984 | Toshiro et al. ..... 219/618 |
| 4,960,967 | A | | 10/1990 | Buffenoir et al. |
| 5,022,044 | A | * | 6/1991 | Thomas ..... 373/151 |
| 5,817,406 | A | * | 10/1998 | Cheung et al. ..... 428/210 |
| 5,866,884 | A | * | 2/1999 | Cornec et al. ..... 219/622 |
| 5,994,681 | A | | 11/1999 | Lloyd |

FOREIGN PATENT DOCUMENTS

| | | |
|---|---|---|
| JP | 57-57490 | 4/1982 |
| JP | 2003-124085 | 4/2003 |

* cited by examiner

*Primary Examiner*—Daniel Robinson
(74) *Attorney, Agent, or Firm*—Laurence A. Greenberg; Werner H. Stemer; Ralph E. Locher

(57) ABSTRACT

A workpiece carrier for the inductive heating of workpieces contains ceramic materials at least at bearing surfaces which come into contact with the workpieces. The ceramic materials are distinguished by a high dimensional stability, low thermal and electrical conductivity and a high resistance to thermal shocks. A process for producing a ceramic material for a workpiece carrier obtains a suitable ceramic material by infiltrating a porous carbon skeleton with silicon. Processes for inductive heating and inductive hardening of workpieces with the workpiece carrier are also provided.

10 Claims, 1 Drawing Sheet

WORKPIECE CARRIER FOR THE INDUCTIVE HEATING OF WORKPIECES, PROCESS FOR PRODUCING A CERAMIC MATERIAL FOR THE WORKPIECE CARRIER AND PROCESS FOR THE INDUCTIVE HEATING OR HARDENING OF WORKPIECES

BACKGROUND OF THE INVENTION

Field of the Invention

The invention relates to a workpiece carrier for the inductive heating of workpieces. The workpiece carrier contains ceramic materials at least at regions of its surface which come into contact with the workpieces. The invention also relates to a process for producing a ceramic material for the workpiece carrier and a process for the inductive heating or inductive hardening of workpieces.

An important application area for heating by electromagnetic induction is the hardening of workpieces made from steel or cast iron. The surface hardening of workpieces made from steel or cast iron is carried out at temperatures below the softening point. Hardening operations are typically carried out at temperatures of from 850 to 1000° C.

During the inductive hardening, a coil (inductor) through which radiofrequency alternating current generally flows surrounds the workpiece that is to be hardened. According to the law of induction, an alternating magnetic field is built up around each conductor through which an alternating current flows. As a result, eddy currents are induced in a conductive material located within that field. The induced eddy currents, which are displaced into the outer workpiece layers by the skin effect, heat those regions very quickly due to the electrical resistance. The frequency f of the alternating current is a crucial factor in determining the depth of hardening. The thickness δ of the layer in which approximately 85% of the heat generated is active is:

$$\delta = \sqrt{\frac{\rho}{f\mu}}$$

(wherein ρ=electrical resistivity, and μ=magnetic permeability ($\mu_r * \mu_0$). The lowest depth of hardening which can be achieved, at high frequencies, is approximately 0.1 mm. At lower frequencies, the layer through which the current flows is thicker, i.e. the current flows through the workpiece and heats it down to a deeper level. That effect is exploited in order to set the desired depth of heating by selecting the frequency.

The particular advantage of inductive heating is that the heat is generated in the workpiece itself without an external heat source being required. Heating by induction can be very accurately controlled and is therefore very reproducible.

Further application areas for the inductive heating of workpieces made from metal are the melting of steels and nonferrous metals at temperatures of up to 1500° C., heating for forging to 1250° C., soft-annealing and normalizing after cold-forming at temperatures from 750 to 950° C., soldering and brazing at temperatures of up to 1100° C., and the tempering of steel at 200 to 300° C. In addition, special application areas reside, for example, in heating for adhesive bonding, sintering or for other treatment processes.

Advantages of induction hardening over conventional hardening processes are the defined supply of heat and the uniform heating of the hardening regions. It is also possible to partially harden the workpiece.

The heat is not transferred to the workpiece from the outside, as in the case of flame hardening, but rather is formed in the interior of the workpiece. Consequently, high heating rates can be achieved. Due to the short heating times involved in inductive hardening, the cycle times are short, little scale is formed and the formation of coarse grains in the hardened material is substantially avoided. The short heating time reduces the risk of distortion and cracking.

The current which is induced in the workpiece is to a very considerable extent dependent on the position of the workpiece relative to the induction coil. In order to achieve reproducible hardening results in series production of workpieces, each workpiece has to be placed in the same position relative to the induction coil for the hardening process. Different workpiece geometries mean different inductors and workpiece carriers matched to the respective workpiece geometry.

The material of the workpiece carrier which is used for the inductive hardening should be electrically nonconductive or should only have a very low electrical conductivity, so that as little current as possible is induced in the workpiece carrier, otherwise it would cause energy to be lost.

The workpiece carrier itself should be heated to the minimum possible extent through contact with the workpiece, so that little heat is extracted from the workpiece.

It is customary for the hardening process to be concluded by a quenching operation in order to accelerate cooling and to optimize the specific properties of the workpiece that is to be hardened. If at that time the workpiece is still on the workpiece carrier, the workpiece carrier also has to be resistant to thermal shocks of at least 1200 K/s. At the same time, a high resistance to chemical and/or oxidation attack is also required in order to allow the quenching medium to be selected as desired. Furthermore, it is necessary to select materials which do not have an absorbing action and/or swell under the influence of liquids, such as for example the quenching emulsion.

Since the regions of the workpiece carrier which receive the workpiece generally have individual geometries matched to the respective workpiece, and the high investment costs required for that purpose are only economically viable for a large number of hardened workpieces, a long service life of the workpiece carrier is required. Preconditions therefor in turn are a low level of wear and a high dimensional stability (geometric accuracy) of the workpiece carrier.

SUMMARY OF THE INVENTION

It is accordingly an object of the invention to provide a workpiece carrier for the inductive heating of workpieces, a process for producing a ceramic material for the workpiece carrier and a process for the inductive heating or hardening of workpieces, in particular workpiece carriers made from a material which satisfies the above requirements and allows workpiece carriers of complex geometries to be produced, and in which the carrier and the processes overcome the hereinafore-mentioned disadvantages of the heretofore-known devices and processes of this general type.

With the foregoing and other objects in view there is provided, in accordance with the invention, a workpiece carrier for the inductive heating of workpieces. The workpiece carrier comprises surface regions configured to be in contact with the workpiece and ceramic material disposed at least at the surface regions.

Therefore, the object of the invention is achieved by virtue of the fact that at least the region of the workpiece carrier which comes into contact with the workpiece that is to be heated contains ceramic materials, so that the workpiece carrier has a hard, wear-resistant surface in the contact region.

With the objects of the invention in view, there is also provided a process for producing a ceramic material for a workpiece carrier. The process comprises producing a porous carbon skeleton and infiltrating the porous skeleton with silicon.

With the objects of the invention in view, there is additionally provided a process for the inductive heating of workpieces. The process comprises inductively heating workpieces with the workpiece carrier.

With the objects of the invention in view, there is furthermore provided a process for the inductive hardening of workpieces. The process comprises inductively hardening workpieces with the workpiece carrier by placing the workpiece carrier at least partially within an induced field during a hardening operation.

Other features which are considered as characteristic for the invention are set forth in the appended claims.

Although the invention is illustrated and described herein as embodied in a workpiece carrier for the inductive heating of workpieces, a process for producing a ceramic material for the workpiece carrier and a process for the inductive heating or hardening of workpieces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
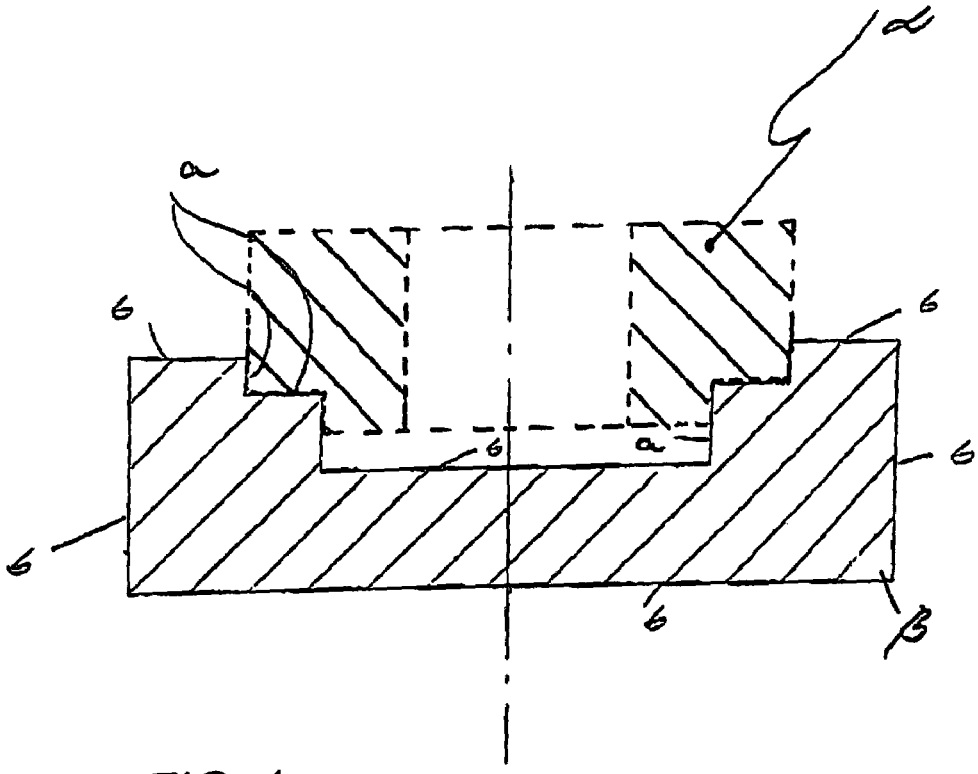
FIG. 1 is a diagrammatic, sectional view of a workpiece carrier according to the invention, the surface of which has a coating of a ceramic material in the regions intended to support the workpiece.

Referring now to the figures of the drawings in detail and first, particularly, to FIG. 1 thereof, there is seen a workpiece carrier β according to the invention which can be produced by coating a region a of a surface of the workpiece carrier β with a ceramic material. The workpiece carrier β is made from a conventional material, for example from a thermoset which is able to withstand high temperatures and is reinforced with glass fibers. The region a is intended to support a workpiece a that is to be hardened. A surface b of the workpiece carrier which is not in contact with the workpiece α is uncoated. However, it is also possible for the entire surface of the workpiece to be coated, for example in situations in which a complete coating is simpler to produce for process engineering reasons than a targeted coating restricted to certain parts of the surface. Processes for producing ceramic coatings, for example plasma spraying or chemical vapor deposition (CVD), are known to the person skilled in the art.

Figure 2:
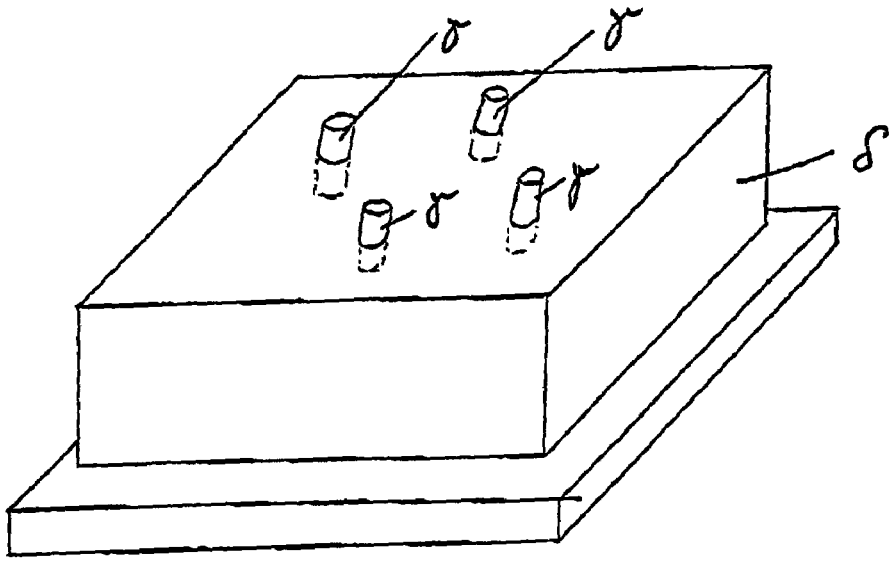
FIG. 2 is a perspective view of a workpiece carrier according to the invention, with inlays made from a ceramic material, which form a support for the workpiece that is to be hardened, and which are introduced into its surface.

An alternative variant of the workpiece carrier according to the invention is illustrated in FIG. 2. At least one cutout, into which an inlay γ of matching shape made from a ceramic material is inserted, is provided in that surface region of a workpiece carrier base body δ which is intended to support the workpieces that are to be hardened. The workpiece carrier base body δ is made from a conventional high-temperature-resistant material, for example high-temperature-resistant thermoset reinforced with glass fibers. Outwardly facing surfaces of the inlays are configured in accordance with requirements of the geometries of the workpieces that are to be hardened, for example they may have channels, grooves or other forms of recesses for receiving the workpiece (which is not shown in FIG. 2). The inlay(s) perform the supporting function for the workpiece, i.e. the workpiece is held by the inlay(s), so that only the surfaces of the inlay(s) but not the surface of the base body are in contact with the workpiece.

The inlays may be removable, so that the workpiece carrier can be matched to various workpiece geometries, by appropriately inserting inlays which match the workpiece to be hardened. Alternatively, the inlays may be securely joined to the workpiece carrier by adhesive bonding, press-fitting or the like.

The geometries of the workpiece carriers and workpieces illustrated in FIGS. 1 and 2 are to be understood purely as examples, since the invention is not restricted to any specific geometry of workpiece carrier and workpiece.

Finally, in the context of the present invention, it is also possible for the entire workpiece carrier to be formed from a single piece of ceramic material.

The electrical resistivity of the ceramic material inserted in the workpiece carriers according to the invention is at least 50 μΩ*m, preferably more than 100 μΩ*m and particularly preferably more than 150 μΩ*m.

The following text gives the compositions of suitable ceramic materials for the workpiece carriers according to the invention. In the case of coated workpiece carriers (FIG. 1), the following details relate only to the composition of the coating in the surface regions a which are in contact with the workpiece. In the case of workpiece carriers with inlays (FIG. 2), the compositions apply only to the inlays γ.

Suitable ceramic materials are ceramics selected from the group including the oxide ceramics ($Al_2O_3$, $ZrO_2$, MgO), the nitride ceramics ($Si_3N_4$, AlN, SIALON) and the carbide ceramics (SiC, TiC, WC, $B_4C$). The material does not have to be 100% ceramic, but its ceramic content must be at least 10% by mass.

By way of example, it is possible to use carbide-ceramic composite materials, which in addition to the carbide(s) itself/themselves also contain phases in which the carbide constituents are in elemental form (i.e. are not bonded in the carbide). Therefore, in addition to carbide, the ceramic material contains phases of elemental carbon and/or metallic phases composed of the metal(s) which form(s) the carbide(s), such as silicon, titanium, tungsten. In this material, it is preferable for the carbide to form at least 10% by mass. The remainder of the material, up to 100%, contains at most 50% carbon and at most 80% fusible elements (the carbide-forming metal or metals in elemental form).

A material which satisfies the above requirements relating to dimensional stability, low electrical and thermal conductivity, chemical resistance and resistance to thermal shocks particularly well, is a ceramic composite material including at least 35% by mass of silicon carbide together with fractions of elemental carbon (1-35% by mass) and elemental silicon (1-60% by mass). The starting basis for the production of this highly ceramicized material is a porous carbon skeleton. The latter is infiltrated with liquid silicon, so that a composite material which predominantly contains silicon carbide, silicon and carbon is formed. Alternatively, the silicizing may be effected via the gas phase.

Composite materials containing silicon carbide and carbon are also obtainable by the addition of silicon-containing polymers which form silicon carbide when pyrolyzed, e.g. silanes or siloxanes, to the porous carbon skeleton, followed by pyrolysis. Materials in accordance with the latter variant can be densified further with silicon by a liquid silicizing operation immediately after the pyrolysis or in a separate step.

The porous carbon skeleton of the starting material is either already in carbonized form, for example as a carbonized felt or nonwoven, or is produced by pyrolysis (carbonization) of a precursor body made from a carbonizable solid material, i.e. a carbon source which can be converted with a high yield into carbon, for example wood, wood-based composites, wood chips, wood flours, cellulose, pulp or wool or textile structures formed from cellulose or wool.

The porous carbon skeleton or the pyrolyzable precursor body from which the porous carbon skeleton is produced may be impregnated one or more times with a carbonizable binder in order to be densified, and the carbonizable binder is then carbonized. Examples of binders which can be carbonized, i.e. pyrolyzed with a high carbon yield, include phenolic resins, melamine resins, lignin and pitch. Furthermore, it is possible to use binders which simultaneously act as a silicon carbide source, for example a silane or siloxane, the pyrolysis of which, in addition to carbon, also forms silicon carbide, or mixtures of different binders or different binders in different impregnation steps.

Alternatively, the starting material for the porous carbon skeleton may be a mixture of carbon, for example in the form of fibers or milled material, or one or more solid carbon sources which can be pyrolyzed (carbonized) with a high carbon yield, e.g. wood flour, wood chips, pulp or cellulose fibers, and a carbonizable binder. A green body, which produces a porous carbon skeleton when it is pyrolyzed, is produced from this mixture, for example by pressing or some other shaping method.

Additives can be added to the mixture in order to match the properties of the composite material even more fully to the requirements which are to be satisfied, e.g. to reduce the thermal and electrical conductivity and to increase the strength. By way of example, additives in the form of powders and fibers with a length of less than 10 mm formed from ceramic materials, e.g. silicon carbide or aluminum oxide fibers, are suitable for this purpose.

The addition of a carbon fraction to the mixture of solid pyrolyzable carbon sources (e.g. wood chips, wood flour, cellulose fibers, pulp) and carbonizable binders from which the green body is produced makes it possible to significantly reduce shrinkage during pyrolysis. This carbon fraction is obtained by adding carbon in the form of carbon or graphite powder, soot, short carbon fibers (with a length of less than 10 mm) or carbon nanotubes to the mixture.

The degree of conversion into silicon carbide can be influenced by the quantity of carbon in the starting material. In the case of the use according to the invention, the composition of the ceramic composite material is set in such a manner that the carbon constituents which are not converted into silicon carbide are, as far as possible, encapsulated by silicon and/or silicon carbide, so that there are no continuous conduction paths. In particular, in the regions of the workpiece carrier which are in direct contact with the workpiece that is to be hardened, the level of carbon that has not been converted into carbide in the composite material must be very low and preferably zero, in order to prevent, inter alia, carburization of the workpiece. Therefore, a high degree of conversion of the carbon into silicon carbide is required. This can be achieved, for example, by a relatively long holding time for the silicizing temperature above the melting point of silicon (typically more than 60 minutes).

The material has the high electrical resistivity required, due to the encapsulation of the residual carbon which has not been converted into carbide. Resistivities of around 170 $\mu\Omega$*m were determined, i.e. within the particularly preferred range of more than 150 $\mu\Omega$*m.

Surprisingly, this encapsulation of the carbon simultaneously has a positive effect on the thermal shock properties of the materials described. The resistance to thermal shocks is greater than 1200 K/s and therefore satisfies the requirements set at the outset. The resistance to oxidation effects is also positively influenced by the encapsulation of the carbon.

It was possible for the workpiece carriers according to the invention to be exposed to up to 10,000 hardening cycles at approximately 1,000° C. and each lasting 3 to 5 minutes without a significant drop in mass or oxidation attack on the surface being observed.

The ceramic body composed of the composite material containing silicon carbide, silicon and carbon is either itself used as a workpiece carrier or is used as an insert for receiving the workpieces in a workpiece carrier made from a conventional material in accordance with FIG. 2.

It is preferable to produce a green or precursor body which is already near net shape, to lower the level of outlay involved in the shaping of the ceramic material. Depending on the nature of the starting material, this is done, for example, by injection molding, pressing (e.g. in a suitably shaped die), stamping, cutting, turning or other standard processes. When constructing the green body, it should be borne in mind that a certain amount of material shrinkage occurs in particular during pyrolysis. Therefore, the green bodies may have to be overdimensioned to compensate for the shrinkage. However, as has already been mentioned, the amount of shrinkage can be reduced by adding carbon to the starting material that is to be pyrolyzed.

If final contouring of the ceramic body to match the geometry of the workpieces to be received is still required, this is done through the use of standard processes, such as drilling, grinding, erosion and the like. However, for economic reasons, it is desirable for the ceramic body or the ceramic subregions of the workpiece carrier to be produced with a surface and geometry quality which is such that in the ceramic state it requires little if any machining, for example so that the remachining is restricted to the production of drilled holes. Measures for producing ceramic bodies with a high surface quality which do not require any remachining are known to the person skilled in the art. In this context, it is advantageous, for example, to use very fine-grained starting materials.

Exemplary Embodiments

EXAMPLE 1

A porous carbon body in plate form with a density of 0.5-0.8 g/cm$^3$ is produced from carbonized felt mats stacked on top of one another and densified. This precursor body was brought into contact with liquid silicon in vacuo. In the process, the majority of the carbon constituents were converted into silicon carbide. The residual porosity is filled by elemental silicon, as far as possible.

After the silicizing, the final shaping took place to produce a workpiece carrier for receiving crank shafts during the hardening process. For this purpose, elongate recesses with a U-shaped cross section were machined out of one surface of the plate-like body through the use of an electro-erosion process with a tolerance of less than ±0.1 mm. This machining operation achieved the required surface quality without the need for an additional surface treatment.

EXAMPLE 2

The carbonized felt used in Example 1 was milled. The milled material was mixed with a pyrolyzable binder, pressed to form a round blank in disk form, cured, pyrolyzed, shaped by machining and silicized. During the shaping, a surface of the blank was machined out in such a way as to have an elevated encircling edge. The ceramic shaped body obtained in this way serves as a workpiece carrier during the inductive surface hardening of running surfaces for ball bearings. The elevated encircling edge acts as a fixing edge for the workpieces that are to be hardened.

EXAMPLE 3

A panel of beech wood was pyrolyzed, brought into the shape of a workpiece carrier for receiving gearwheels and then silicized via the liquid phase. The pyrolyzed wood panel was correspondingly overdimensioned in form due to the expected shrinkage of approximately 40% of the starting volume during silicizing. The silicized shaped body was remachined to accurately set the desired dimensions.

EXAMPLE 4

Milled, pulverulent wood flour was mixed with phenolic resin and cured under the action of pressure (12 N/mm$^2$) and temperature (up to at most 130° C.) in a die cavity to form what is known as a wood-based composite. The die which was used formed the contour of a shaped part with an elongate recess which is U-shaped in cross section on one surface.

The green body obtained in this way was pyrolyzed and converted by silicizing into a ceramic body rich in silicon carbide. This body is used to fix threaded rods during inductive hardening.

EXAMPLE 5

Open-pore green bodies were produced by compression molding from a raw material obtained by infiltration of wood flours with a polymer that forms silicon carbide when pyrolyzed. These green bodies were converted into highly ceramicized SiSiC bodies (density 2.0-3.15 g/cm$^3$, resistivity 172 μΩ*m) during the subsequent pyrolysis and silicizing.

The green bodies were in the form of workpiece carriers with fixing edges for workpieces that are to be received. The ceramic bodies obtained in this way are used as workpiece carriers for the inductive hardening of transmission components.

EXAMPLE 6

Carbon powder with a particle diameter of 5-30 μm was admixed as an additive to wood flour infiltrated with a pyrolyzable binder. A green body was produced therefrom in the form of a perforated plate. This green body was pyrolyzed and silicized. The additive significantly reduces the shrinkage of the precursor bodies during pyrolysis. This allowed the desired geometry to be realized with sufficient dimensional accuracy and without the need for remachining.

The ceramic body obtained in this way was used as a receiving device for metal bolts that are to be hardened.

EXAMPLE 7

A mixture of pulp and cellulose with lignin as binder was pressed to form a near net shape green body in the form of a plate with fixing edges for workpieces. Following the pyrolysis operation, this body had a very fine-pore microstructure. After the infiltration of liquid silicon, the result was an SiSiC material containing over 30% by mass of elemental silicon not bonded in the carbide. The elemental carbon formed less than 3% by mass.

The shaped parts obtained in this way are used as retaining aids for workpieces in induction hardening installations.

EXAMPLE 8

Workpiece Carrier With Inlays

A workpiece carrier base body was produced from a plastic which is able to withstand high temperatures and contained $Al_2O_3$ as filler. A surface of this base body was provided with bores into which cylindrical shaped parts (pins) made from $Al_2O_3$ were pressed. The outwardly facing surfaces of these ceramic pins served as a support for the workpieces that are to be hardened.

The cylindrical ceramic shaped parts were produced by casting a preparation of the starting material in slip form into suitable molds and sintering this material.

EXAMPLE 9

Workpiece Carrier with Ceramic Coating of the Surfaces Which Come Into Contact with the Workpiece A workpiece carrier having an elongate recess which is U-shaped in cross section for receiving threaded rods to be hardened was produced from a plastic which is able to withstand high temperatures. The wall of the recess which comes into contact with the workpiece during hardening was then coated with silicon carbide using the plasma spraying process.

This application claims the priority, under 35 U.S.C. § 119, of European Patent Application 04 010 372.3, filed Apr. 30, 2004; the entire disclosure of the prior application is herewith incorporated by reference.

I claim:

1. A workpiece carrier for the inductive heating of workpieces, the workpiece carrier comprising:

a base body made from a material able to withstand high temperatures, said base body having a surface and at least one inlay of ceramic material fitted into said surface of said base body, said inlay having surface regions configured for carrying the workpiece and to be in contact with the workpiece; and ceramic material disposed at least at said surface regions and being substantially non-conductive or having low electrical conductivity sufficient to substantially avoid induction of secondary current in the workpiece carrier.

2. The workpiece carrier according to claim 1, wherein said ceramic material coats said surface regions.

3. The workplace carrier according to claim 1, wherein the workpiece carrier is entirely formed of ceramic material.

4. The workpiece carrier according to claim 1, wherein said ceramic material is a material selected from the group consisting of oxide and nitride ceramics.

5. A workpiece carrier for the inductive heating of workpieces, the workpiece carrier comprising:

surface regions configured to be in contact with the workpiece; and carbide ceramic material disposed at least at said surface regions, said carbide ceramic material containing:

at least one carbide phase formed with at least one metal; and at least one of:

phases of elemental carbon or metallic phases composed of said at least one metal forming said at least one carbide phase.

6. The workpiece carrier according to claim 5, wherein said carbide phase forms at least 10% by mass of said ceramic material, and said ceramic material has a remainder, up to 100%, made up of at most 50% elemental carbon and at most 80% of said at least one metal forming said at least one carbide phase in elemental form.

7. The workpiece carrier according to claim 5, wherein said ceramic material is a ceramic composite material composed of silicon carbide, elemental silicon and elemental carbon.

8. The workpiece carrier according to claim 7, wherein said ceramic composite material includes at least 35% by mass of silicon carbide, from 1 to 60% by mass of silicon and from 1 to 35% by mass of carbon.

9. The workpiece carrier according to claim 5, wherein said carbide ceramic contains at least some carbon being a product of pyrolysis of a material selected from the group consisting of wood, wood-based composites, wood chips, wood flour, cellulose, pulp and wool.

10. The workpiece carrier according to claim 5, wherein said elemental carbon contains at least some carbon being a product of pyrolysis of a material selected from the group consisting of wood, wood-based composites, wood chips, wood flour, cellulose, pulp and wool.

* * * * *